United States Patent [19]

Nagy et al.

[11] 4,029,990

[45] June 14, 1977

[54] SPARK PLUG CONSTRUCTION

[75] Inventors: William L. Nagy, Northwood; Robert J. Craver, Sylvania, both of Ohio

[73] Assignee: Champion Spark Plug Company, Toledo, Ohio

[22] Filed: Jan. 9, 1976

[21] Appl. No.: 647,819

[52] U.S. Cl. ..... 315/62; 313/124

[51] Int. Cl.[2] ..... H01T 13/46

[58] Field of Search ..... 313/124, 134; 315/62

[56] References Cited

UNITED STATES PATENTS 3,267,325 8/1966 Why ..... 315/61 X

*Primary Examiner*—Rudolph V. Rolinec

*Assistant Examiner*—Darwin R. Hostetter

*Attorney, Agent, or Firm*—Oliver E. Todd, Jr.

[57] ABSTRACT

An improved spark plug for use in an internal combustion engine having a capacitive discharge ignition system. The spark plug includes a conventional metal shell supporting an insulator having a center electrode bore extending therethrough. A center electrode mounted in the insulator bore includes an electrode tip which defines a spark gap with a ground electrode. An auxiliary spark gap is formed within the insulator bore immediately above the tip. A low resistance inductive suppressor is mounted above the auxiliary spark gap and has an end attached to a terminal for connection to the capacitive discharge ignition system.

4 Claims, 1 Drawing Figure

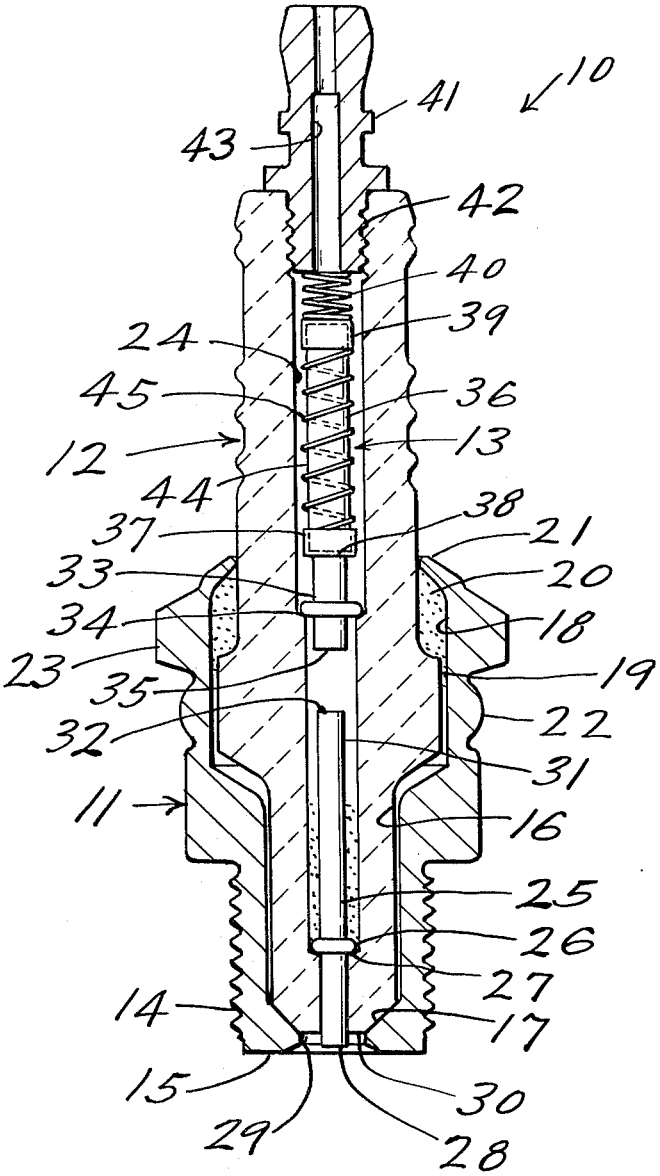
10
41
43
42
40
39
24
45
36
12
13
44
38
37
21
33
20
34
18
23
19
35
22
32
31
11
16
25
26
27
14
17
15
30
29
28

SPARK PLUG CONSTRUCTION

BACKGROUND OF THE INVENTION

This invention relates to spark plugs and more particularly to an improved spark plug for use in an internal combustion engine having a capacitive discharge ignition system.

High voltage ignition circuits for spark-ignited internal combustion engines commonly produce spurious radiation in the radio frequency spectrum. It is desirable to reduce or eliminate such radio frequency radiation since it may interfere with communication systems, navigation systems and other systems using the same radio frequency spectrum. Various techniques have been used in the past for suppressing radio frequency radiation from high voltage ignition circuits. These techniques generally consist either of placing an ignition noise suppression element in either the high voltage ignition cables or in the center electrode of each spark plug or of distributing an ignition noise suppressor in the high voltage ignition cables. For ignition systems of the Kettering type which include a set of cam driven breaker points which periodically interrupt current flow to the primary winding of an ignition coil, the ignition noise suppressor generally comprises a resistor either of the carbon type or of the wire wound type. Resistors of up to 10,000 ohms or more have little detrimental affect on the operation of the spark plug for igniting a fuel-air mixture while providing a considerable reduction in radio frequency interference. However, where the spark plug is energized from the newer capacitive discharge ignition systems, high resistance ignition noise suppressors adversely affect the operation of many systems. Many capacitive discharge ignition systems cannot tolerate a high resistance in the high voltage output circuit because a high resistance slows the fast rise time of the ignition pulse applied to the spark gap. In addition, although capacitive discharge ignition systems are generally designed to provide higher output voltages, some systems are somewhat marginal on current available to the spark gap. This is particularly true for capacitive discharge ignition systems commonly used on two stroke engines such as those used in outboard motors and snowmobiles. Such systems are designed with a relatively low output impedance, e.g., 50,000 ohms, to provide a fast rise time. If a high resistance ignition noise suppressor is placed in series in the high voltage circuit, the available current at the spark gap is further limited.

It has been suggested, for example, in U. S. Pat. No. 3,882,341 which issued May 6, 1975, that a low resistance inductor is effective to suppress radio frequency radiation from a high voltage ignition circuit connected to a capacitive discharge ignition system without adversely affecting the operation of the circuit. This patent shows a spark plug having a center electrode assembly including a low resistance inductor formed from wire wound on a ferrite core. The inductor is connected in series between an electrode tip and a terminal by means of either one or two springs. The inductor effectively suppresses radio frequency oscillations from the high voltage circuit without appreciably affecting the D.C. current available to the spark gap.

U.S. Pat. No. 3,267,325 discloses a spark plug having an internal oscillatory circuit. The spark plug has a center electrode including at least one inductor and at least one spark gap. The diameter of the center electrode is relatively large as compared to the average outside diameter of the insulator and a portion of the insulator is coated with a layer of silver which is electrically grounded through the spark plug shell. This coating cooperates with the large center electrode assembly for greatly increasing the capacitance between the center electrode assembly and ground to complete the oscillatory circuit. The circuit is designed to oscillate in the 2 to 20 megahertz range to provide steep voltage rises so that the plug will fire despite a shunt resistance caused by heavy fouling deposits on the insulator. However, the oscillatory circuit is a radio frequency signal generator which will inherently increase radio frequency radiation from the high voltage circuit.

Auxiliary spark gaps have also been provided in the center electrode of prior art spark plugs. The function of such gaps has been to improve the operation of the spark plug when partially fouled. Since the operating voltage must be sufficient to jump both the primary and the auxiliary spark gaps at the same time, there is a sudden current flow in the spark plug and energy will not be dissipated as readily through a shunting resistance across the primary spark gap caused by fouling deposits on the insulator.

SUMMARY OF THE INVENION

According to the present invention, an improved spark plug is provided for use in internal combustion engines having capacitive discharge ignition systems. The spark plug has both ignition noise suppression properties and also anti- fouling properties. The spark plug of the present invention includes a conventional insulator mounted in a tubular metal shell having a threaded end for engaging the head of an internal combustion engine. A ground electrode either is formed from the shell in the case of a surface gap spark plug or is attached to the shell adjacent the threaded end for defining one terminal of a spark gap. A center electrode assembly is mounted within a bore extending through the insulator. The center electrode assembly includes a tip for defining a spark gap with the ground electrode. Above the tip, the center electrode assembly defines an auxiliary spark gap of from 0.050 inch to 0.300 inch. A low resistance inductive suppressor is connected in the center electrode above the spark gap and has an end which is attached to a terminal for connection to a high voltage ignition cable leading to the capacitive discharge ignition system. It has been found that by placing the auxiliary spark gap below the inductive suppressor and near the electrode tip, the spark gap not only provides anti-fouling properties to the spark plug, but it also helps suppress radio frequency radiation from the high voltage ignition system. On the other hand, if the spark gap is located between the inductive suppressor and the terminal, the spark gap is detrimental to the suppression properties of the spark plug over those achieved either by a spark plug including only an inductive suppressor in the center electrode assembly or by a spark plug including a spark gap located between the inductive suppressor and the electrode tip.

Accordingly, it is an object of the invention to provide an improved spark plug for operation in internal combustion engines having capacitive discharge ignition systems.

Another object of the invention is to provide an improved spark plug for internal combustion engines having both anti-fouling and ignition noise suppression properties.

Other objects and advantages of the invention will become apparent from the following detailed description, with reference being made to the accompanying drawing.

BRIEF DESCRIPTION OF THE DRAWING

The single FIGURE shows an enlarged vertical cross-sectional view of a spark plug constructed in accordance with the present invention.

DESCRIPTION OF THE PREFERRED EMBODIMENT

Turning now to the drawing, a vertical cross section is shown of a spark plug 10 constructed in accordance with the present invention. The spark plug 10 generally comprises a metallic shell 11, an insulator 12 and a center electrode assembly 13. The spark plug 10 is designed for operation in internal combustion engines having capacitive discharge ignition systems and is constructed to have both suppression properties for reducing radio frequency ignition noise and anti-fouling properties. The spark plug 10 shown in the drawing is of a surface gap type having a spark gap extending along a surface 30 of the insulator 12. However, it should be appreciated that other known spark plug constructions such as those having a separate extended ground electrode or those having a recessed thin wire ground electrode are also adaptable for practicing the present invention.

The spark plug shell 11 has a generally tubular shape with a threaded portion 14 adjacent an end 15 for threadably engaging the head of an internal combustion engine. A shaped opening 16 extends through the shell 11 for receiving the insulator 12. The shaped opening 16 includes a radially inwardly directing annular shoulder 17 adjacent the lower shell end 15 on which the insulator 12 is seated. The shaped opening 16 also includes an enlarged diameter portion 18 which closely receives a flange 19 on the insulator 12. A resilient packing material 20, such as talc, is packed within the annular region defined between the insulator 12 and the shell 11 above the flange 19. During assembly of the spark plug 10, an upper shell 21 of the shell 11 is folded over the top of the resilient packing material 20 and the shell 11 is subsequently axially collapsed at a thin walled portion 22 to place the packing material 20 in a highly compressed condition. The compressed packing material 20 biases the insulator 12 against the annular shoulder 17 to form a gas tight seal between the insulator 12 and the shell 11. The shell 11 also includes a shaped exterior portion 23, which is preferably hexagonal, for receiving a wrench to facilitate attaching the spark plug 10 to and removing it from a threaded opening in the head of an internal combustion engine in a conventional manner.

The insulator 12 includes a stepped axial bore 24 for mounting the center electrode assembly 13. The center electrode assembly 13 includes an electrode tip 25 having a shoulder 26 which engages a lower step 27 in the bore 24. The tip 25 includes a lower end 28 which projects from the insulator 12 for defining a spark gap with a ground electrode 29 which is shown as being formed integrally on the shell 11. However, as indicated above, the ground electrode 29 may be in the form of a separate wire welded or otherwise attached to the lower shell end 15 for defining a spark gap with the tip portion 28. In the embodiment of the spark plug 10 shown in the drawings, the insulator surface 30 extends across the spark gap defined between the projecting electrode tip end 28 and the ground electrode 29. Spark plugs of this design are known as surface gap spark plugs and, in some instances, the surface 30 may be coated or impregnated with a semiconductor material.

The electrode tip 25 also has a shank portion 31 which extends upwardly in the insulator bore 24. A suitable sealing material, such as talc, is packed around the shank portion 31 to hold the electrode tip 25 within the insulator bore 24 with the shoulder 26 seated against the lower bore step 27 to prevent gas leakage between the electrode tip 25 and the insulator 12. Of course, other known sealing methods such as the formation of a glass seal may be provided between the electrode tip 25 and the insulator 12. The electrode tip 25 has an upper end 32 which defines one terminal of an auxiliary spark gap formed in series in the center electrode assembly 13. A rivet or support member 33 is seated on a step 34 within the insulator bore 24 and includes a lower end 35 for forming the other terminal of the auxiliary spark gap. An inductive suppressor 36 is positioned within the insulator bore 24 such that it has an end terminal 37 which rests upon an upper end 38 of the support member 33. The inductive suppressor 36 has a second terminal end 39. A spring 40 is located between the terminal end 39 and an end terminal 41 which forms the upper end of the center electrode assembly 13. The terminal 41 has a lower threaded end 42 which threadably engages the insulator bore 24 to prevent movement of the terminal 41 relative to the insulator 12. The spring 40 biases the inductive suppressor 36 against the support 33 to maintain the support 33 seated against the step 34 formed in the insulator bore 24. The terminal 41 is also provided with a vent opening 43 for venting the region between the center electrode assembly 13 and the walls of the insulator bore 24.

As indicated above, the auxiliary spark gap is defined by the upper end 32 of the electrode tip 25 and the lower end 35 of the support member 33. The auxiliary gap should fall within the range of from 0.050 inch to 0.300 inch and preferably falls within the range of 0.150 inch to 0.250 inch. If the gap is smaller than about 0.050 inch, its effectiveness in increasing the performance of the spark plug 10 when the insulator surface 30 is fouled with combustion deposits is greatly decreased over the larger gaps. On the other hand, if the gap is appreciably larger than about 0.300 inch, an excessive voltage is required to jump both the auxiliary spark gap and the primary spark gap formed between the electrode tip end 28 and the ground electrode 29.

The inductive suppressor 36 generally comprises a cylindrical core 44 to which the terminals 37 and 39 are attached. A wire 45 is wound upon the core 44 between the terminals 37 and 39 to give the desired inductance. The wire 45 forming the inductance is of a highly conductive material, such as copper or a copper alloy, as distinguished from a high resistance material. The actual value of the inductive suppressor 36 may vary over a wide range and will have an optimum value determined by the output characteristics of the ignition system connected to the spark plug terminal 41. Generally, the inductor 36 should have an inductance of at least ten microhenry to be effective in suppressing the ignition noise. It should be appreciated that the inductance value of the inductive suppessor 36 should also be picked to provide an optimum average level of suppression over a wide frequency spectrum. In one engine in which a spark plug similar to the spark plug 10 was installed and operated, an inductance of 40 microhenry provided the optimum level of suppression over higher and lower inductance levels. It should also be appreciated that the actual inductance value of the inductive suppressor 36 will be limited by the available space within the insulator bore 24. Normally, an inductor such as the inductive suppressor 36 mounted within a spark plug bore 24 will have a maximum inductance of no more than about 100 microhenry when provided with a ceramic core. When desired, the value of the inductance can be increased considerably by providing a ferrite core, as is disclosed in U.S. Pat. No. 3,882,341. The actual resistance value of the inductive suppressor 36 will also vary from inductor to inductor depending upon the diameter of the wire 45, the length of the wire 45 between the terminals 37 and 39 and the material forming the wire 45. Generally speaking, as more turns of wires are added to the suppressor 36 to increase the inductance, the resistance will also increase unless there is also an increase in the diameter of the wire 45. The suppressor 36 should be designed to have a low resistance. For example, wire wound inductors having an inductance on the order of 37 to 40 microhenry and resistances on the order of 30 to 40 ohms were found to be effective in suppressing ignition noise when installed in the center electrode of a spark plug having an auxiliary gap of 0.150 inch located between such inductors and the electrode tip and operated in an internal combustion engine having a capacitive discharge ignition system. Preferably, the resistance of the suppressor 36 should be no more than about 50 ohms. However, the maximum permissible resistance value of the inductive suppressor 36 will depend upon the actual output impedance and the output current available from the capacitive discharge ignition system connected to the spark plug 10.

It will be appreciated that various modifications and changes may be made in the above-described spark plug 10 without departing from the spirit and the scope of the following claims. For example, various changes may be made in the manner in which the spark plug insulator 12 is attached within the shell 11 and changes may be made in the design of the insulator 12 and of the spark gap defined between the electrode tip end 28 and the ground electrode 29 in accordance with the teachings of the prior art. The primary consideration in constructing the center electrode assembly 13 is to locate the auxiliary spark gap between the inductive suppressor 36 and the primary spark gap. A spark plug in which the auxiliary spark gap is placed between the inductive suppressor 36 and the terminal 41 rather than between the inductive suppressor 36 and the main or primary spark gap loses much of its effectiveness as an ignition noise suppressing spark plug.

What we claim is:

1. An improved spark plug for use in an internal combustion engine having a capacitive discharge ignition system, said spark plug comprising, in combination, a tubular metal shell having an exterior threaded section for threadably engaging the engine, ground electrode means in electrical circuit with said shell, an insulator mounted in said shell, said insulator having an axial bore extending therethrough, a center electrode, and means mounting said center electrode in said shell, said center electrode including tip means mounted to project from said insulator bore for defining a primary spark gap with said ground electrode means, a low resistance inductive suppressor having two ends, means forming an auxiliary spark gap within said insulator bore between said tip means and one end of said inductive suppressor, and terminal means for connecting the other end of said inductive suppressor to the capacitive discharge ignition system, said inductive suppressor having an inductance and said auxiliary spark gap having a gap size for suppressing oscillatory electrical ignition noise.

2. An improved spark plug for use in an internal combustion engine having a capacitive discharge ignition system, as set forth in claim 1, wherein said internal spark gap has a gap spacing within the range of 0.050 inch and 0.300 inch.

3. An improved spark plug for use in an internal combustion engine having a capacitive discharge ignition system, as set forth in claim 2, wherein the resistance of said inductive suppressor is less than 50 ohms.

4. An improved spark plug for use in an internal combustion engine having a capacitive discharge ignition system, as set forth in claim 1, wherein said insulator bore has two axially spaced steps, and further including means mounting said tip means in said bore seated against one of said steps and support means seated on the other of said steps for supporting said one end of said inductive suppressor, and wherein said auxiliary spark plug gap is formed between said tip means and said support means.

* * * * *